US007459672B2

(12) United States Patent
Jensen et al.

(10) Patent No.: US 7,459,672 B2
(45) Date of Patent: Dec. 2, 2008

(54) MOTION SENSOR WITH LED AIMING AID

(75) Inventors: Bradford B. Jensen, Saint Joseph, MI (US); Kim I. McCavit, Saint Joseph, MI (US)

(73) Assignee: Jenesis International, Inc., Benton Harbor, MI (US)

( * ) Notice: Subject to any disclaimer, the term of this patent is extended or adjusted under 35 U.S.C. 154(b) by 4 days.

(21) Appl. No.: 11/655,671

(22) Filed: Jan. 19, 2007

(65) Prior Publication Data

US 2008/0174429 A1 Jul. 24, 2008

(51) Int. Cl.
*G06M 7/00* (2006.01)

(52) U.S. Cl. ..... 250/221; 340/555; 396/153

(58) Field of Classification Search ..... 250/221; 340/555; 396/153
See application file for complete search history.

(56) References Cited

U.S. PATENT DOCUMENTS

| | | | | |
|---|---|---|---|---|
| 4,760,381 | A | 7/1988 | Haag | |
| 5,371,489 | A * | 12/1994 | Carroll et al. | 340/565 |
| 5,763,872 | A * | 6/1998 | Ness | 250/214 AL |
| 6,215,398 | B1 | 4/2001 | Platner et al. | |
| 6,531,966 | B2 | 3/2003 | Krieger | |
| 2005/0041964 | A1 * | 2/2005 | Schnell | 396/153 |
| 2005/0116171 | A1 | 6/2005 | Lee et al. | |
| 2005/0200494 | A1 * | 9/2005 | Herrmann et al. | 340/693.5 |
| 2006/0092378 | A1 * | 5/2006 | Marsden et al. | 352/221 |
| 2006/0176697 | A1 * | 8/2006 | Arruda | 362/276 |
| 2006/0231763 | A1 * | 10/2006 | Walters | 250/353 |

FOREIGN PATENT DOCUMENTS

| | | |
|---|---|---|
| GB | 2 064 108 A | 6/1981 |
| GB | 2 215 454 A | 9/1989 |
| GB | 2 365 524 A | 2/2002 |

OTHER PUBLICATIONS

International Search Report and Written Opinion.

* cited by examiner

*Primary Examiner*—Georgia Y. Epps
*Assistant Examiner*—Kevin Wyatt
(74) *Attorney, Agent, or Firm*—Paul W. O'Malley; Susan L. Firestone

(57) ABSTRACT

A motion sensor incorporates an internal light source, typically a super bright LED. A multi-lens system or an arrangement of small windows in front of the LED projects a visible light pattern that mimics the detection pattern of the motion sensor to an observer standing in the detection zone and looking at the sensor.

8 Claims, 7 Drawing Sheets

MOTION SENSOR WITH LED AIMING AID

BACKGROUND OF THE INVENTION

1. Technical Field

The invention relates to motion sensors and more particularly to a motion sensor with a built in aiming/alignment aid.

2. Description of the Problem

A typical passive infrared ("PIR") motion sensor uses a multiple Fresnel lens system to create a fixed number of detection zones. The optical alignment of each lens of the lens system with the internal infrared detector defines a detection zone that extends outward in front of the sensor. Each detection zone is only a few inches wide near the sensor, but expands at greater distances in a manner determined by the focal length of each lens. Even so, with the typical focal lengths used in PIR motion sensors, the detection zone will only be a few feet wide at a range of fifty feet. In order to achieve adequate sensitivity, the lenses cannot be made arbitrarily small, so a typical motion sensor lens will have about 20 elements in the lens system. If the motion sensor is designed to cover a large area, the relatively small number of detection zones means there will be large portions of the monitored area in which motion cannot be detected. There is no clear indication to the user that indicates where the monitored and un-monitored areas will be. However, to operate properly, the motion sensor must be mounted and aimed so that the detection zones cover adequately the target area. Both the horizontal and vertical mounting angles of the motion sensor must be set properly in order to keep the detection zones within the area that is to be monitored. Even a small error can result in a motion sensing system that does not adequately monitor the target area.

Since the detection zones of a PIR motion sensor are not visible, proper alignment can become quite tedious. During installation the user must essentially guess at the correct sensor angles and then walk around in front of the motion sensor to try to confirm that the detection zones are positioned properly. The motion sensor typically provides an LED or a special test mode to facilitate this walk test. When the user moves through one of the detection zones, either the LED will flash or a light will turn on briefly to indicate that motion has been detected. Due to the nature of the electronics used with motion sensors, the user must then wait a few seconds for the motion sensor to re-stabilize before he can continue the test. Using this trial and error approach, the user can eventually determine the position of each of the detection zones and adjust the motion sensor until the detection zones are positioned properly. Since this process is prone to error and, if done properly, very time consuming, the results of the installation are often less than ideal. A typical problem with PIR motion sensors is that care must be taken to insure that none of the detection zones contains a heat source or other object that might cause false triggers. While such objects are usually listed in the operation manual and are easy to identify, actually determining whether or not such an object is in one of the detection zones can be quite difficult.

In a similar manner, active ultrasonic and microwave motion sensors can be difficult to aim. These types of motion sensors typically have one continuous detection zone rather than a multitude of detection zones, but they also do not provide any visible feedback that allows the user to determine the shape and placement of the detection zone. These types of sensors send a signal into the detection zone (either microwave or ultrasonic) and then measure the reflected signals in order to detect motion. The shape of the detection zone can be controlled by the type of transducers used and their mechanical arrangement on the motion sensor. As with PIR motion sensors, the only way to properly align the motion sensor is to perform the slow and tedious walk around test.

U.S. Pat. No. 6,531,966 describes a device that incorporates a laser pointer with a motion sensor. A visible light pattern is generated by the laser, but the laser pointer is not visible in the detection zones of the motion sensor. Rather, the laser pointer is independently adjustable with respect to the motion sensor. The intent is to use the motion sensor to detect a car entering a parking area. When motion is detected, the motion sensor triggers operation of the laser. The laser pointer is aimed to illuminate a particular spot on the car when it is parked in the proper position. The motion sensor's primary purpose is to conserve battery power by turning off the laser when no motion is detected.

U.S. Pat. No. 6,215,398 describes a device which uses two LED's similar to the test LED used as alignment aids in many PIR motion sensors. The LED's are placed behind the lens and located so that they illuminate the lens from behind whenever motion is detected. They are positioned behind selected lens segments so the segment detecting an observer will look brighter to the observer since it will be better focused where the observer is standing. This approach has several drawbacks. For one, ideally the LED and the PIR detector should be in the same position relative to the lens segment. Since this is not physically possible, LED position is compromised. Also, this technique only works if the lens is relatively clear. It is often desirable to use a lens that has pigments added to make it match a desired color. These pigments block visible light from the LED while allowing infrared energy to pass through. Even without pigments, the material used to make this type of lens is often quite milky and diffuses visible light. When lit from behind, a lens made from this material would diffuse the LED light throughout the lens and defeat the intent of creating a relatively brighter spot if the user were standing in a position that should appear to be more focused. In addition, the lens has only a few, very large lenses and only two LEDS. It would not be practical to extend this approach to a lens system that had a substantially greater number of lens elements. Properly positioning 20 or more LED's behind the corresponding lenses would not allow the differentiation in lens brightness that would be required to identify the correct lens when standing at a distance from the motion sensor. Finally, as with the typical walk test LED, a stop and go approach must be used since the user must stop moving and wait for the motion detecting circuits to stabilize and turn the LED back off each time motion is detected.

SUMMARY OF THE INVENTION

A motion sensor incorporates an internal light source, typically a super bright LED. A multi-lens system or an arrangement of small windows in front of the LED projects light visible to an observer standing in the coverage area of the sensor. The ability to view the light simplifies the proper installation of the motion sensor. The invention could be used in any motion sensor system that uses a motion sensing technology that is not visible to the human eye. This would include, but not be limited to, passive infrared (PIR), ultrasonic, and microwave (Radar) motion sensors.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
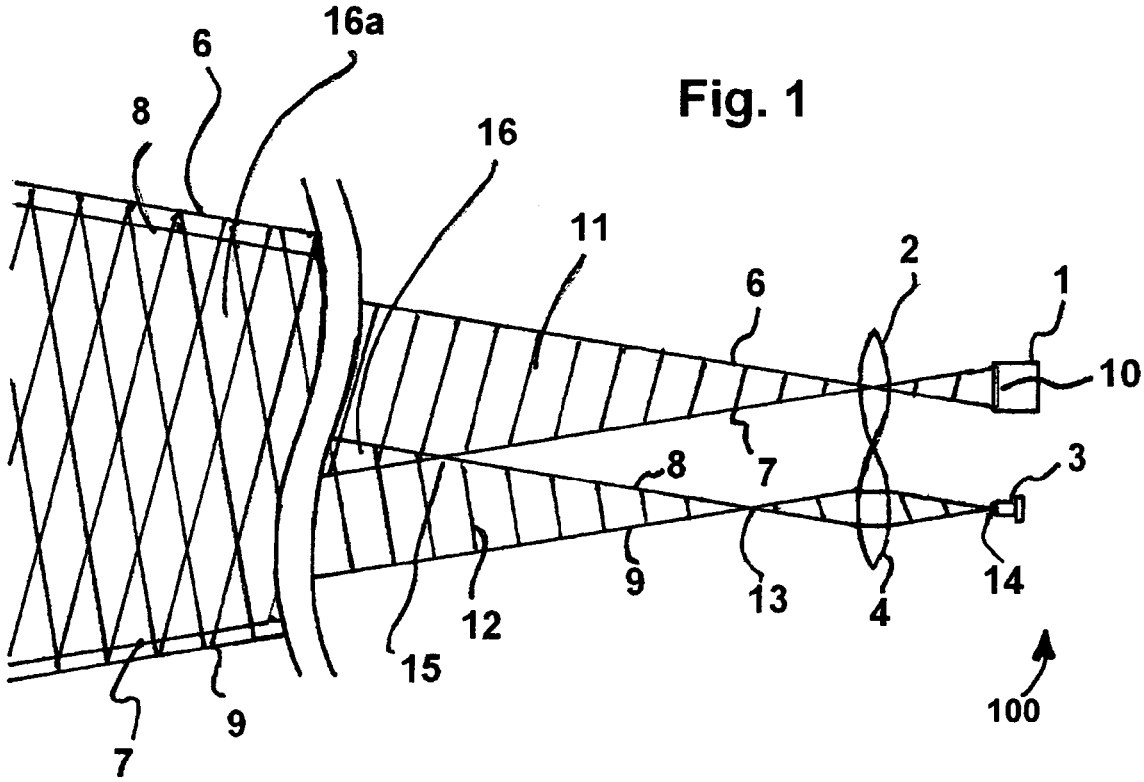
FIG. 1 is a graphical depiction of the interaction between a zone of passive monitoring of a motion sensor and a coverage zone of an LED light source used for orienting the housing in which both are installed.

Referring to FIG. 1, a simplified representation of a PIR motion sensor 100 incorporating the present invention is illustrated. PIR detector 1 is located behind a lens 2 at the focal point of the lens. As those skilled in the art will understand, tracing two rays 6, 7 from the edges of the active element 10 of the PIR detector 1 through the center of the lens defines an area 11 within which any radiated infrared (IR) energy will be focused on the PIR detector. IR energy from outside this region would not be focused on the PIR detector element 10. For ease of description, only the rays within the plane of the illustration are considered although it is understood that there would also be similar defining rays extending above and below the plane of the illustration. Similarly, PIR detectors would generally have two or more active elements, but only one is shown to simplify the drawings.

An LED 3 is positioned below PIR detector 1 and positioned behind another converging lens 4 relative to an outside observer. Light rays leaving the internal point source 14 from LED 3 pass through the lens 4 and are focused at a point 13 in front of the lens. The focal length of the lens 4 and its position relative to the LED 3 can be chosen so that exiting ray 8 and incoming ray 6 are parallel. Similarly, exiting ray 9 and incoming ray 7 are parallel. These two rays 8, 9 define a region 12 within which light emanating from LED 3 will be visible to an observer when looking at the sensor housing of PIR detector 1. Outside this region, the light emanating from LED 3 would not be visible. At a point 15 a short distance in front of the lens, the regions 11 and 12 overlap to form a new region 16. Within region 16, the light emanating from LED 3 is visible and IR energy radiated by an object in front of the PIR motion sensor 100 is focused on the PIR detector 1. The region 16 is identical in shape to regions 11 and 12 and is only offset a small amount as determined by the distance between PIR detector 1 and the LED 3. As detailed in the extended view portion of FIG. 1, the cross section of region 16 becomes larger as the distance from the motion sensor increases. When the cross section of the expanded region 16*a* becomes significantly larger than the offsets between rays 6, 8 and 7, 9, then for all practical purposes, region 16*a* is coincident with regions 11 and 12. As such, looking toward sensor 101 and being able to see the light emanating from LED 3 confirms to an observer that he is within the motion detecting zone defined by region 11. It is understood in this illustration that the two-dimensional depiction of the invention renders regions 11, 12 and 16 as triangular areas. In three dimensions, region 11 would become a rectangular pyramidal volume since the PIR detector element 10 is typically rectangular in shape. Similarly, in three dimensions region 12 would become a conical volume. The overlapping region 16 would then also become a conical volume in three dimensions. While the cross section of the conical volume 16 would not exactly match the cross section of the rectangular pyramidal volume 11, the differences are small enough that for all practical purposes the volumes can still be treated as identical.

Since the radiation of interest passing through lens 2 is of a different wavelength than the visible light transmitted by lens 4 some adjustment to compensate for differences in the indices of refraction may be made if desired, though in practice this should not be necessary. For example if the detector and LED are the same distance from their respective lenses, which are made of the same material, than the lenses may be of slightly differing curvatures.

Figure 2:
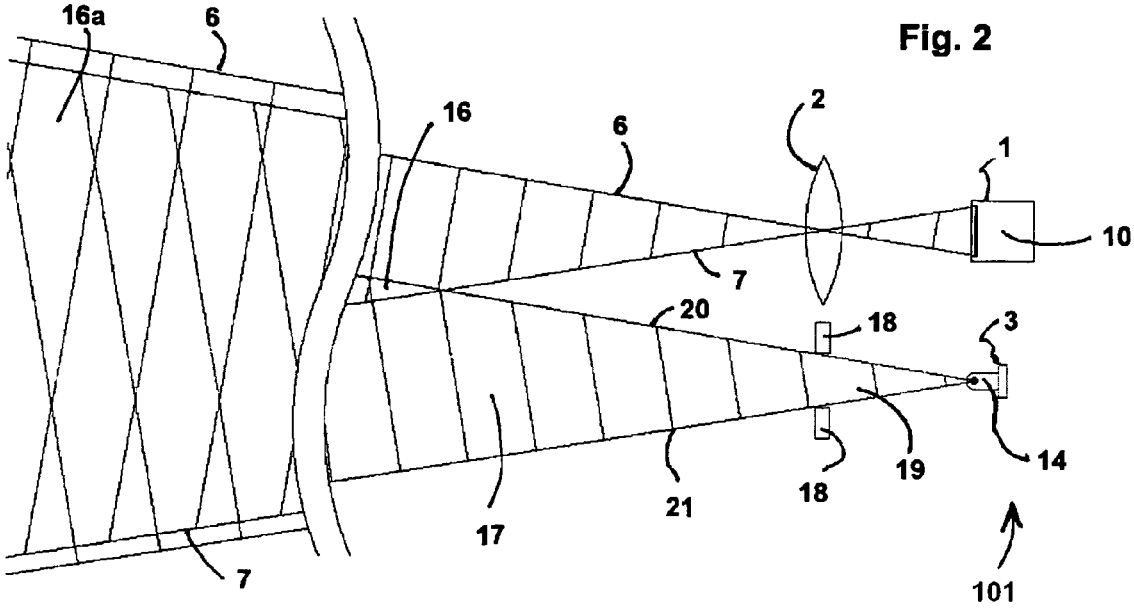
FIG. 2 is a graphical depiction of the interaction between a zone of passive monitoring of a motion sensor and a coverage zone of an LED light source used for orienting the housing in which both are installed.

FIG. 2 shows an alternative embodiment of the invention in which the lens in front of the LED 3 has been replaced by a slot 19 cut into an opaque face 18 of a PIR motion sensor 101. Lines drawn between the edges of the slot and the point source 14 within the LED 3 define two rays 20, 21. The width of the slot 19 and the distance to the LED 3 can be selected so that exiting ray 20 is parallel to incoming ray 6 and exiting ray 21 is parallel to incoming ray 7. Similar to the arrangement of FIG. 1, a region 16 is created within which the light emanating from the LED 3 is visible and from within which radiated IR energy is focused on the PIR detector element 10. When extended to three dimensions, region 11 becomes a rectangular pyramidal volume, as in FIG. 1. When expanded to three dimensions, the cross section of region 17 will assume the shape of the slot 19 . If the cross section of the slot 19 is rectangular with the same length to side ratios as the PIR detector element 10, the cross sections of the volumes corresponding to 11, 17 and 16 can be made nearly coincident. However, the cross section of the slot 19 could be made some other shape as long as the resulting cross section of volume 17 was very similar in size to the cross section of volume 11. As in FIG. 1, the extended view shown in FIG. 2 illustrates that the cross section of region 16 becomes larger as the distance from the motion sensor increases. When the cross section of the expanded region 16*a* becomes significantly larger than the offsets between rays 6, 8 and 20, 21, then for all practical purposes region 16*a* corresponds identically to regions 11 and 17. As such, when an observer looking in the direction of sensor 101 is able to see the light emanating from LED 3, he knows that he is within the target area established by the motion detecting zone defined by region 11.

Figure 3:
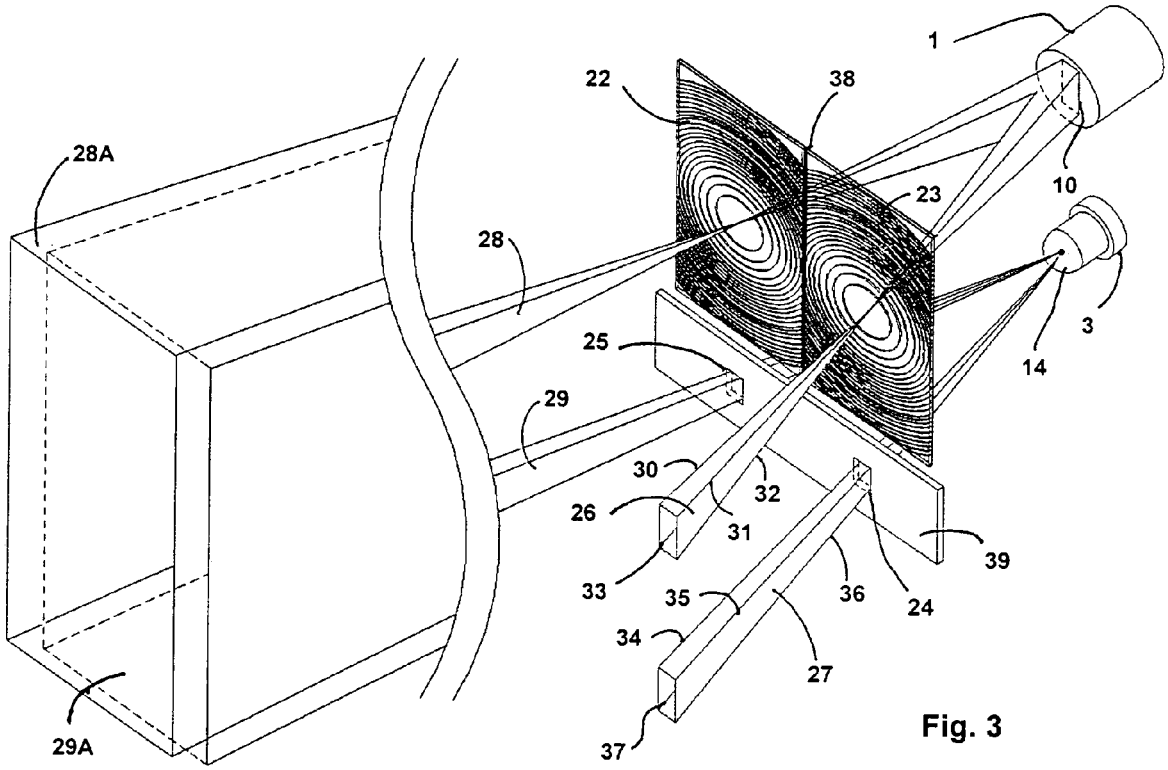
FIG. 3 is a perspective view of the active components of a motion sensor including the alignment support features of the invention.

FIG. 3 shows an implementation of the invention using a multi-element Fresnel lens system 38 disposed in front of the PIR detector 1. A typical Fresnel lens system used with a motion sensor may have twenty or more lens elements, but only two lenses 22, 23 are shown in FIG. 3. Tracing rays from the corners of the active element 10 through the optical center of Fresnel lens 23 defines a volume/zone 26 within which radiated infrared (IR) energy will be focused on the PIR detector element 10. Similarly, lens 22 defines a second volume 28 from within which radiated IR energy is also focused on the PIR detector element 10. An LED 3 is positioned behind an opaque barrier 39. A slot 24 through the opaque barrier 39 channels light into a volume 27 within which light emanating from LED 3 is visible. The slot 24 is sized and positioned relative to the LED 3 such that edge 30 of the slot is parallel to edge 34, edge 31 is parallel to edge 35, edge 32 is parallel to edge 36, and edge 33 is parallel to edge 37. At a short distance in front of the motion sensor, volumes 26 and 27 begin to overlap. At greater distances from the motion sensor, volume 26 and volume 27 are virtually coincident. In the extended view it may be seen that volumes 28/28*a* and 29/29*a*, which are generated by lens prism 22 and slot 25, respectively, expand as the distance from the motion sensor increases. When the cross section of these volumes is large compared to the offset between the PIR detector 1 and the LED 3, the two volumes are identical for all practical purposes. When an observer looking toward the sensor is able to see light from LED 3 it confirms to the observer that he is within the detection zone. Those skilled in the art will recognize that this invention is not limited to lenses using only two lenses, but could be expanded to be used with a lens system that contained a multitude of lens elements.

Figure 4:
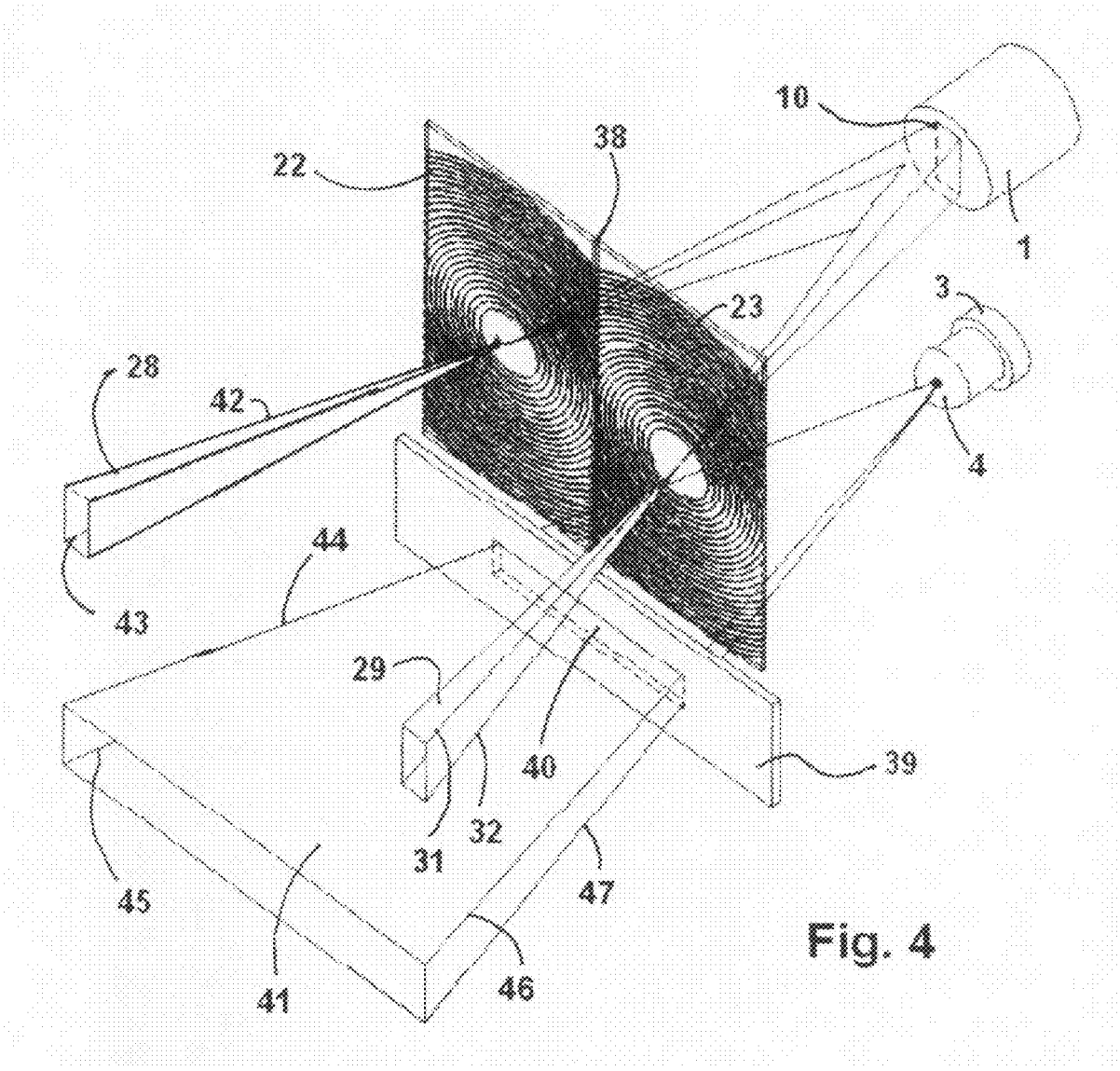
FIG. 4 is a perspective view of the active components of an alternative motion sensor including the alignment support features of the invention.

In many cases, the lens collection system of a PIR motion sensor is designed to provide multiple horizontal rows of detection zones. In such cases, it might be desirable to simplify the installation process by providing visual feedback for each individual row rather than each individual detection zone. Other patterns could be used as well where, for example, the zone of coverage within a target area is discontinuous. FIG. 4 illustrates how multiple detection zones that are arranged linearly can be aligned with a single, extended zone within which the light emanating from LED 3 can be seen. Instead of two individual slots 24, 25, (as shown in FIG. 3) an elongated single slot 40 through an opaque barrier 39 defines an emission zone/volume 41. The slot 40 is sized and positioned relative to the LED 3 such that edge 44 of the zone is parallel to edge 42, edge 45 is parallel to edge 43, edge 46 is parallel to edge 31, and edge 47 is parallel to edge 32. At a short distance in front of the motion sensor, zone 41 begins to overlap both volumes 28 and 29. With such an arrangement, being able to see the light emanating from LED 3 indicates that the user is either in one of the two detection zones 28, 29, or the space in-between them. Those skilled in the art will recognize that this technique is not limited to two lens elements, but could be expanded to be used with a lens that contained a row with a multitude of lenses. In many cases, visual feedback indicating the horizontal extent of the motion detecting zones may be an adequate alignment aid even though the user cannot identify the specific detection zone associated with each individual lens.

Figure 5:
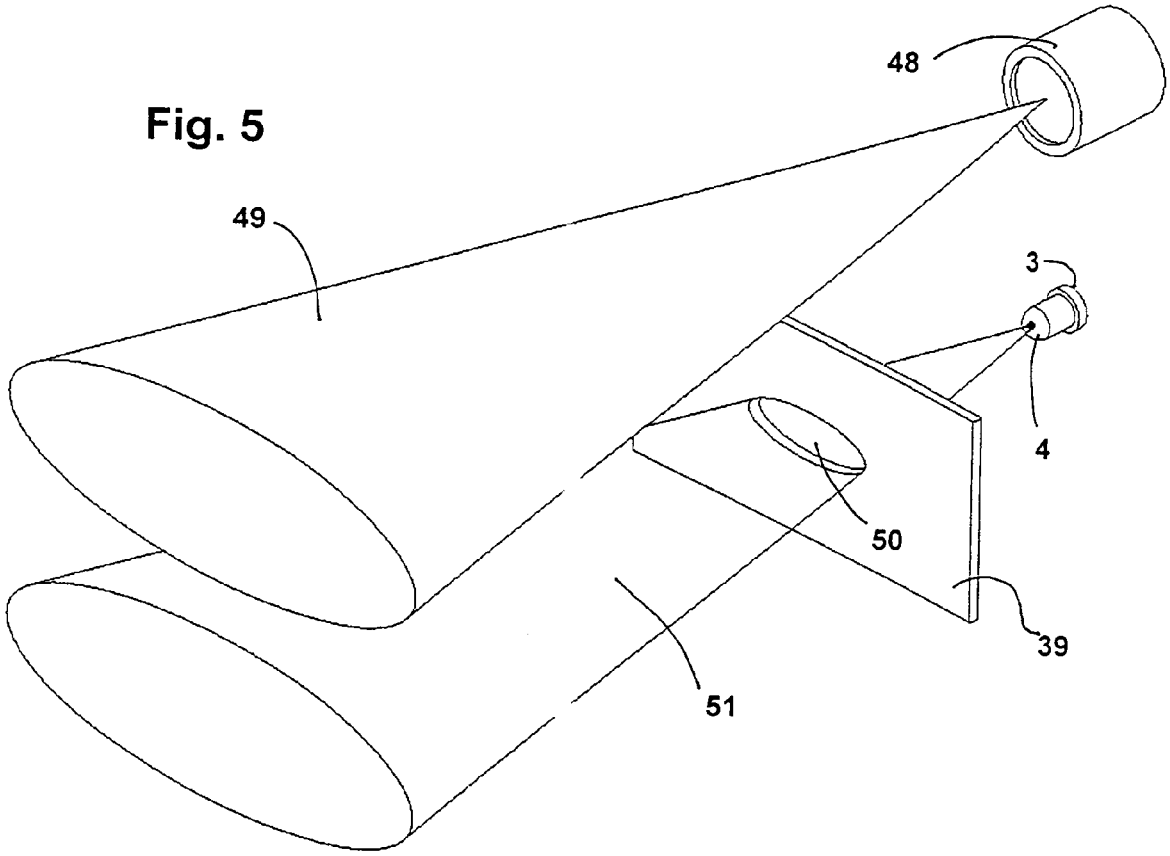
FIG. 5 is a perspective view of the active components of yet another motion sensor including the alignment support features of the invention.

FIG. 5 shows the use of the invention with an ultrasonic transducer 48, which is an example of an active system. The ultrasonic transducer 48 projects ultrasonic energy into the volume in front of the motion sensor. Objects in front of the motion sensor reflect some of this energy. Another transducer (not shown) measures changes in this reflected energy that would indicate motion. The energy emission pattern of ultrasonic transducer 48 defines a volume 49 within which motion can be detected. A slot 50 in opaque barrier 39 is shaped and positioned relative to LED 3 in order to create a corresponding volume 51 within which the light emanating from LED 3 would be visible. In a manner similar to that described above, the shape of slot 50 would be arranged so that rays traced on the surface of volume 51 would be parallel to corresponding rays traced on the surface of volume 49. As a result, the two volumes 49, 51 would begin to overlap a short distance in front of the motion sensor and being able to see the light emanating from the LED 3 would provide a visual indication that the user was within the motion detection zone of the motion sensor. Those skilled in the art will recognize that the ultrasonic transducer 48 could be any type of active transducer including, but not limited to, microwave devices.

Figure 6:
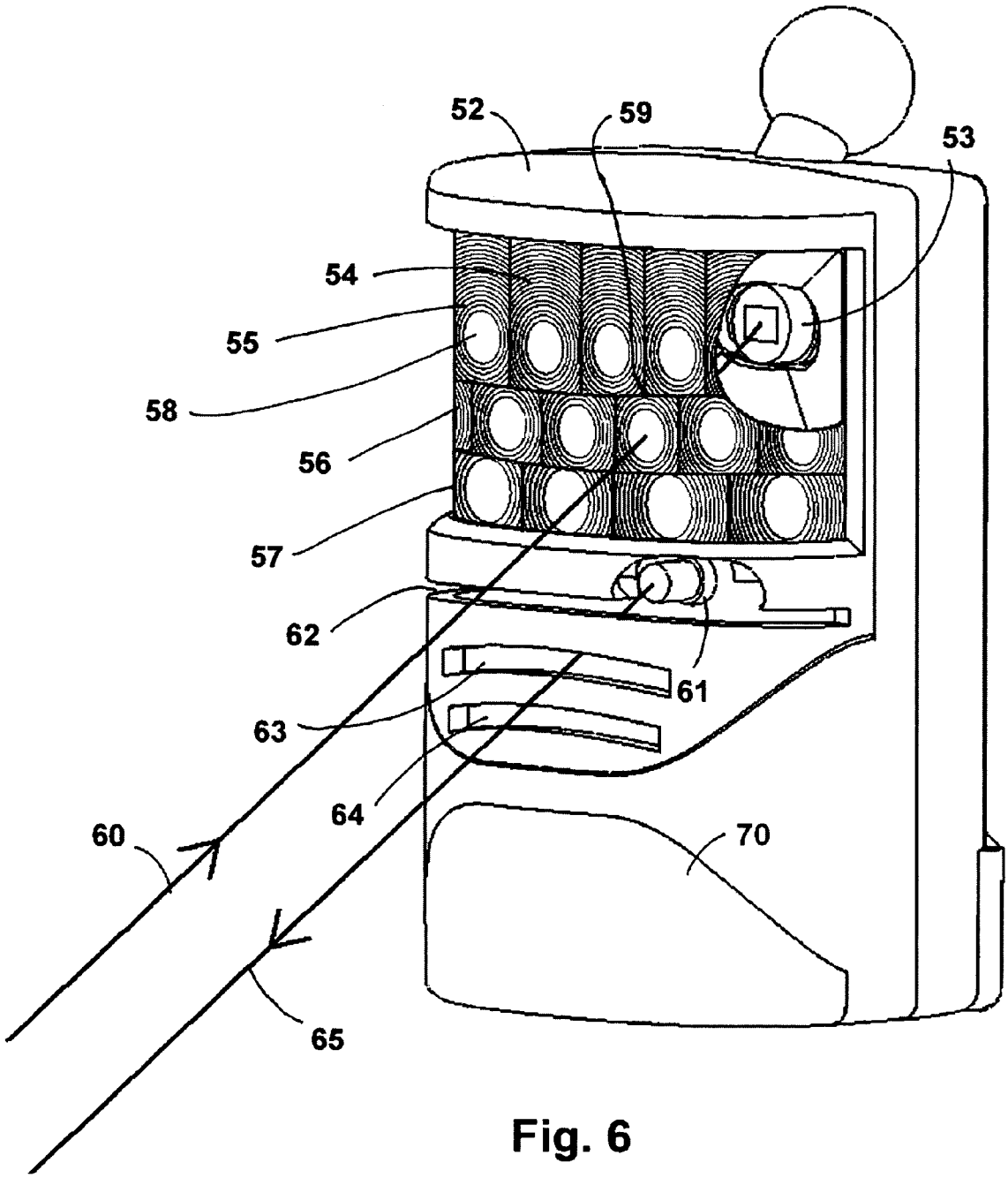
FIG. 6 is a perspective view of a motion sensor incorporating the invention.

FIG. 6 shows a preferred embodiment of the invention using a PIR motion sensor. A motion sensor housing 52 encloses a PIR detector 53 shown in cut-away view. A multi-element Fresnel lens 54 is positioned in front of the PIR detector 53 . The lens 54 is typical of those used in PIR motion sensors and is designed to have three horizontal rows, 55, 56, and 57. Within each row, the optical centers 58 of the Fresnel lens system elements are arranged to form an essentially horizontal line. The motion detecting zones defined by lens system 54 are thus divided into three distinct horizontal rows. The upper row 55 would typically use larger Fresnel lenses in order to increase the amount of IR energy delivered to the PIR detector 53 and thereby maximize the range at which motion can be detected within those zones. The detection zones defined by row 56 would typically be arranged to be about 15 degrees below the detection zones defined by row 55. Similarly, the detection zones defined by row 57 would be arranged to be about 15 degrees below the detection zones defined by row 56. For illustrative purposes, a ray 60 is shown passing through the optical center of lens 59 and striking PIR detector 53. For simplicity, outlines for a single ray are shown, but it is understood that this ray represents a pyramidal volume within which motion would be detected.

FIG. 6 also shows an LED 61 in cut-away view within motion sensor housing 52. Three slots 62, 63, 64 through the front face of housing 52 are located in front of LED 61. Slots 62, 63, 64 would typically be filled with a transparent material (not shown). The width and length of slot 62 is designed such that being able to see the light emanating from LED 61 would indicate to an installer that he/she was within the row of detection zones defined by row 55 of lens 54. Similarly, slots 63 and 64 would be located and sized so that being able to see the light emanating from LED 61 would confirm to the installer that he or she was within the row of detections zones defined by rows 56 and 57, respectively, of lens 54. For illustrative purposes, a ray 65 from LED 61 is shown passing through slot 63. Ray 65 is parallel to ray 60. Where ray 60 is visible it confirms to the user that he or she is standing within the detection zone of lens 59 as represented by ray 60. Section 70 may be depressed to trigger operation of the alignment aid for a predetermined period.

The present invention greatly simplifies the process of aiming a motion sensor by providing a visible light pattern that matches the detection zones created by the multi-element or compound Fresnel lens system. Generally, because the light levels emitted are relatively low, the user stands at a distance from the sensor and looks back at the motion sensor to see the light. If the observer is in the coverage/detection zone of the sensor he will see a bright alignment light (typically a super bright LED). If sufficient power is available, the observer could potentially see when the illuminated field is substantially coincident with the coverage/detection zone. If he is not within a detection zone, the alignment light will not be visible. If the user stands in the position where a detection zone is desired, it is then a simple matter to adjust the sensor head until the alignment light is visible. In the preferred embodiment the alignment light is always on, and since there is no need to delay while waiting for the motion sensor electronics to stabilize, the alignment procedure can be completed quickly and accurately. If desired though, the LED can be made to flash, or even to turn auxiliary lighting on and off when an observer moves into the detection zone. Another alternative would be to provide a chirping noise maker activated, in the test mode, by an installer moving into the coverage zone. It also becomes a simple matter to determine if an object that could cause false triggers is within a detection zone. By simply standing near the object and looking back at the motion sensor, it will be obvious whether or not the object is within the detection zone.

Figure 7:
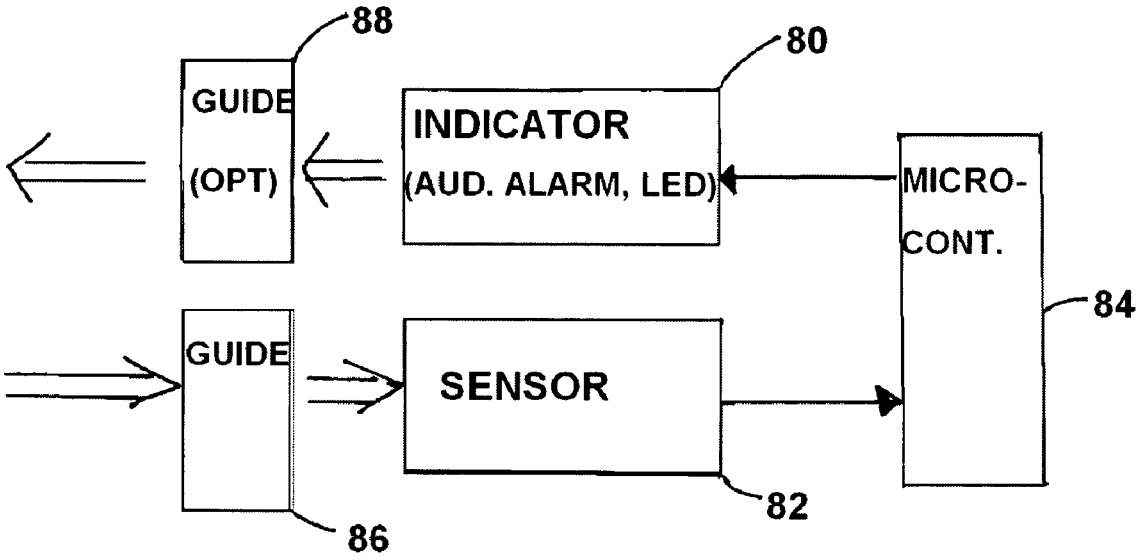
FIG. 7 is a generalized schematic of the invention.

FIG. 7 illustrates the major components of the invention in a high level schematic. Indicators 80 generally embrace the diverse types of output signal generating devices such as LED's or sound generators which can be activated by use of an input switch 87 and/or by movement of an individual into the field of view of the sensor 82. It is anticipated that the device will include at least an optical element, but may also include an acoustic device. A microcontroller 84 may be used to adapt operation of the indicator as desired depending upon operational mode (e.g. installation, normal operation). One of indicators 80, an LED, may be made to flash. The use of two indicators may be useful where the motion sensor is a full motion sensing system and both presence in the coverage area and motion detection are to be verified. The sensor 82, which may be active or passive, is connected to communicate with microcontroller 84, which in turn may be part of a area security system. Both the indicator 80 and the sensor 82 may be supplied with field of view/coverage focusing elements or guides 88, 86, such as lens systems. The guide for the sensor system 82 may be bi-directional if the sensor system is active.

While the sensor packages described herein are broadly referred to as motion sensors, there are several different types of detectors used. Only some of these are truly motion sensors (typically active devices) and others which are more accurately described as heat sensors (usually passive devices). In theory electromagnetic sensors could be used to detect life forms with nervous systems. Active sensors more typically include ultrasonic and microwave systems. Passive sensors include infrared type sensors.

While the invention is shown in only a few of its forms, it is not thus limited but is susceptible to various changes and modifications without departing from the spirit and scope of the invention.

The invention claimed is:

1. A motion sensor comprising:

an enclosure;

a sensing element installed in the enclosure having a detection zone exterior to the enclosure;

an alignment light within the enclosure activated in response to installer selected conditions;

optical projection elements installed on or within the enclosure and relative to the alignment light to project light emitted from the alignment light visible only to an observer located within a target area for the detection zone.

2. A motion sensor as set forth in claim 1, further comprising:

a plurality of detection zones within the target area.

3. A motion sensor as set forth in claim 1, further comprising:

the alignment light is a light emitting diode; and a manual trigger for activating the alignment light.

4. A motion sensor as set forth in claim 3, further comprising:

a plurality of detection zones exhibiting gaps between the detection zones;

an optical sensor element;

a lens system for collecting infrared light from the target area for the optical sensor element; and the optical projection elements and relative positioning of the light emitting diode to the optical projection elements being configured to generate a projection pattern within the target area for the plurality of detection zones.

5. A motion sensor as set forth in claim 4, wherein the sensing element is a passive infrared detector.

6. A motion sensor as set forth in claim 3, further comprising:

a secondary indicator responsive to the motion sensing element to indicate that motion of an object has been detected.

7. A motion sensor as set forth in claim 6, wherein flashing of the alignment light or secondary indicator occurs upon detection of motion.

8. A motion sensor as set forth in claim 6, further comprising an audible alarm system for indicating motion detection.

* * * * *